US005951177A

United States Patent [19]

Schanke et al.

[11] Patent Number: 5,951,177

[45] Date of Patent: Sep. 14, 1999

[54] METHOD AND APPARATUS FOR MAINTAINING RIBBON TENSION

[75] Inventors: Robert L. Schanke, New Berlin; Brent A. Bandholz, West Allis, both of Wis.

[73] Assignee: Brady Worldwide, Milwaukee, Wis.

[21] Appl. No.: 09/033,342

[22] Filed: Mar. 2, 1998

[51] Int. Cl.[6] ..... B41J 33/40

[52] U.S. Cl. ..... 400/218; 400/234

[58] Field of Search ..... 400/207, 208, 400/218, 234, 120.01

[56] References Cited

U.S. PATENT DOCUMENTS

| | | | |
|---|---|---|---|
| 3,554,349 | 1/1971 | Hebert | 400/234 |
| 4,264,396 | 4/1981 | Stewart | 156/361 |
| 4,407,692 | 10/1983 | Torbeck | 156/350 |
| 4,440,248 | 4/1984 | Teraoka | 177/4 |
| 4,468,139 | 8/1984 | Hattori | 400/120 |
| 4,473,426 | 9/1984 | Goodwin et al. | 156/384 |
| 4,477,305 | 10/1984 | Hamisch | 156/384 |
| 4,490,206 | 12/1984 | Makley | 156/384 |
| 4,497,682 | 2/1985 | Hamisch, Jr. | 156/384 |
| 4,498,947 | 2/1985 | Hamisch et al. | 156/384 |
| 4,501,224 | 2/1985 | Shibayama | 118/697 |
| 4,511,422 | 4/1985 | Hamisch et al. | 156/384 |
| 4,544,434 | 10/1985 | Mistyurik | 156/384 |
| 4,556,442 | 12/1985 | Torbeck | 156/350 |
| 4,584,048 | 4/1986 | Hamisch et al. | 156/384 |
| 4,630,538 | 12/1986 | Cushman | 101/45 |
| 4,655,129 | 4/1987 | Wirth et al. | 101/35 |
| 4,680,078 | 7/1987 | Vanderpool et al. | 156/352 |
| 4,788,558 | 11/1988 | Caldwell et al. | 346/76 |
| 4,815,874 | 3/1989 | Richarson et al. | 400/208 |
| 4,917,514 | 4/1990 | Richardson et al. | 400/120 |
| 5,111,216 | 5/1992 | Richardson et al. | 346/764 |
| 5,135,315 | 8/1992 | Kitahara et al. | 400/56 |
| 5,135,319 | 8/1992 | Kobayashi et al. | 400/208 |
| 5,138,335 | 8/1992 | Sugimoto et al. | 346/76 |
| 5,211,491 | 5/1993 | Harvey | 400/208 |
| 5,246,298 | 9/1993 | Sugiura et al. | 400/208 |
| 5,588,756 | 12/1996 | Hamisch et al. | 400/234 |
| 5,605,403 | 2/1997 | Vegeais et al. | 400/207 |
| 5,607,244 | 3/1997 | Satoh et al. | 400/247 |

FOREIGN PATENT DOCUMENTS

| | | | |
|---|---|---|---|
| 5-32031 | 2/1993 | Japan | 400/208 |
| 2175253 | 11/1986 | United Kingdom | 400/208 |

*Primary Examiner*—Stephen R. Funk
*Assistant Examiner*—Amanda B. Sandusky
*Attorney, Agent, or Firm*—Quarles & Brady LLP

[57] ABSTRACT

A bidirectional hand held label printer with a novel labeling media and ink ribbon drive mechanism. A delay is introduced in the labeling media and ink ribbon drive mechanism to pretension the ribbon prior to feeding labeling media and ribbon past the print head. When the drive motor reverses direction, the drive roller stalls momentarily while the take up ribbon drive spindle tensions the ribbon in the desired direction.

3 Claims, 4 Drawing Sheets

METHOD AND APPARATUS FOR MAINTAINING RIBBON TENSION

TECHNICAL FIELD

The present invention relates to a thermal transfer printer, and more particularly to a bidirectional hand held thermal transfer printer.

DESCRIPTION OF THE BACKGROUND ART

There are a number of U.S. patents that disclose electronic apparatus for printing indicia on labels, some of these are restricted to hand held units and others that disclose tabletop units. Hand held labeling machines are disclosed, for example, in U.S. Pat. Nos. 4,264,396, Stewart; 4,407,692, Torbeck; 4,473,426, Goodwin et al.; 4,477,305, Hamisch; 4,490,206, Makely; 4,497,682, Hamisch; 4,498,947, Hamisch et al.; 4,511,422, Hamisch et al.; 4,544,434, Mistyurik; 4,556,442, Torbeck; 4,561,048, Hamisch et al.; and 4,680,078, Vanderpool et al. Tabletop units for this general purpose, some of which are portable are described in U.S. Pat. Nos. 4,440,248, Teraoka; 4,501,224, Shibayama; 4,630,538, Cushing; and 4,655,129, Wirth et al.

The electronic machines for printing labels of the type disclosed above all include the same general combination of elements, a print head, means for feeding labeling media to be printed past the print head, a microprocessor, a read only memory programmed with appropriate instructions to operate the microprocessor, a random access memory, a keyboard with letter, number, and function keys for the entry of alphanumeric information and instructions concerning the indicia to be printed, and a visual display such as a LED, LCD unit to assist the operator in using the machine. In a hand held printer, these components may all be enclosed in a single housing.

The labeling media comprises a series of labels that are attached to a carrier strip. The carrier strip is fed through the printer and legends are printed on the labels. The labels are then removed from the carrier and attached to the objects needing identification. As there are many types of label applications, there are many combinations of labels and carrier strips that provide labels of varying sizes, colors and formats.

A particular type of print head employs thermal transfer printing technology. Thermal transfer printing uses a heat generating print head to transfer a pigment, such as wax, carbon black, or the like, from a thermal transfer ribbon to a labeling media. By using digital technology, characters are formed by energizing a sequence of pixels on the print head which in turn melt the wax or other pigment on the ribbon transferring the image to the labeling media.

In a known thermal transfer printer such as a label printer, labeling media is fed by a paper feed roller simultaneously with a platen roller feeding an ink transfer ribbon. While the labeling media driven by the feed roller runs between the print head and the rotating platen roller, the transfer ribbon is passed between the print head and the platen roller by rotating the platen roller. As a result, the labeling media and the transfer ribbon pass together in overlay relationship between the print head and the platen roller.

Many of prior art thermal printers disclosed above waste portions of the transfer ribbon, labeling media or both. Since the labeling media and the transfer ribbon are fed together at once, if information is printed on a part of a label, or if the labeling media has a non-printing section, that portion of the transfer ribbon which corresponds to the non-printed section is wastefully advanced. One method of reducing this waste is to reverse direction of the ribbon to use the previously wasted portion.

A more significant problem is wastefully transferring labeling media. After printing, labeling media advances to a "cut" or "dispense" position, which requires advancing the labeling media past a label that could otherwise have been printed. One method of reducing this waste is to reverse direction of the ribbon and labeling media to use the previously wasted portion. However, reversing the ribbon can introduce ribbon wrinkling which leads to misprinted labels.

SUMMARY OF THE INVENTION

The present invention is an apparatus and method for reversing the transfer ribbon direction without producing ribbon wrinkling. A delay is introduced in the labeling media and ink ribbon drive mechanism to pretension the ribbon prior to feeding labeling media past the print head. When the drive motor reverses direction, the drive roller, which moves the labeling media and ribbon, stalls momentarily while a take up spool spindle provides tension in the ribbon in the desired direction. This has the effect of pulling all the slack out of the ribbon web before the labeling media and ribbon begin to feed past the print head. The introduction of the delay prevents wrinkles from developing in the ink ribbon and being pulled over the print head.

The general objective of the present invention is to minimize wrinkling in the ink ribbon when the ribbon direction of travel is reversed. By introducing a delay between reversing the direction of the ribbon and driving the labeling media past the print head, the transfer ribbon is pulled tight and free of wrinkles before the labeling media and ribbon are fed past the print head. The preferred embodiment introduces the delay in a stepping motor gear mechanism by incorporating a predetermined backlash in the gear mechanism of the ribbon transmission system.

DETAILED DESCRIPTION OF THE PREFERRED EMBODIMENTS

Figure 1:
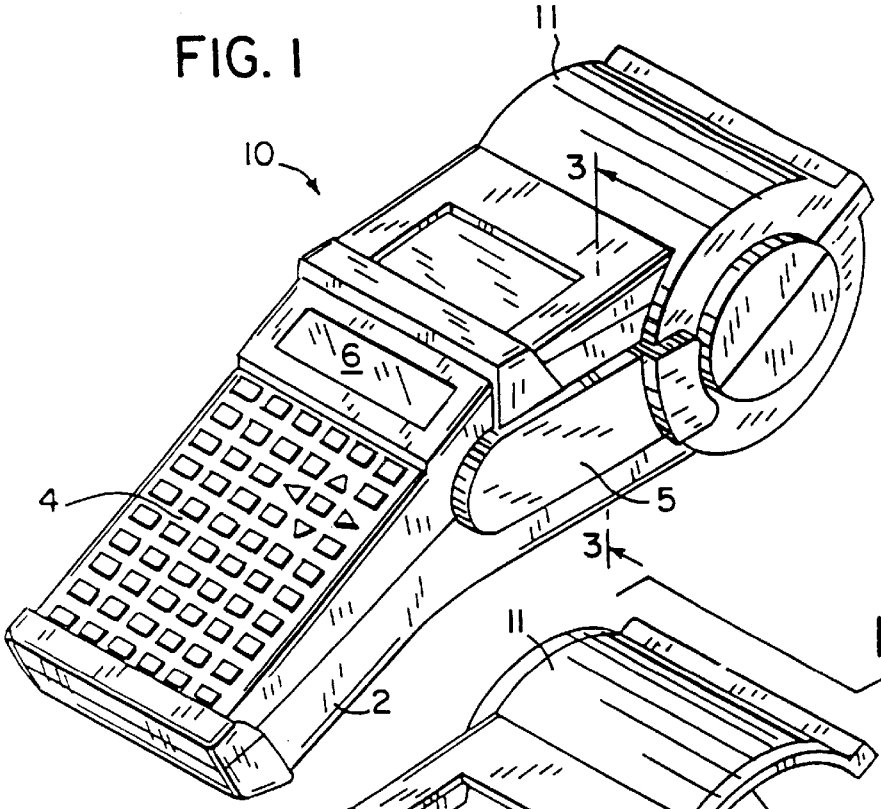
FIG. 1 is a perspective view of a hand held label printer which employs the present invention.
Figure 2:
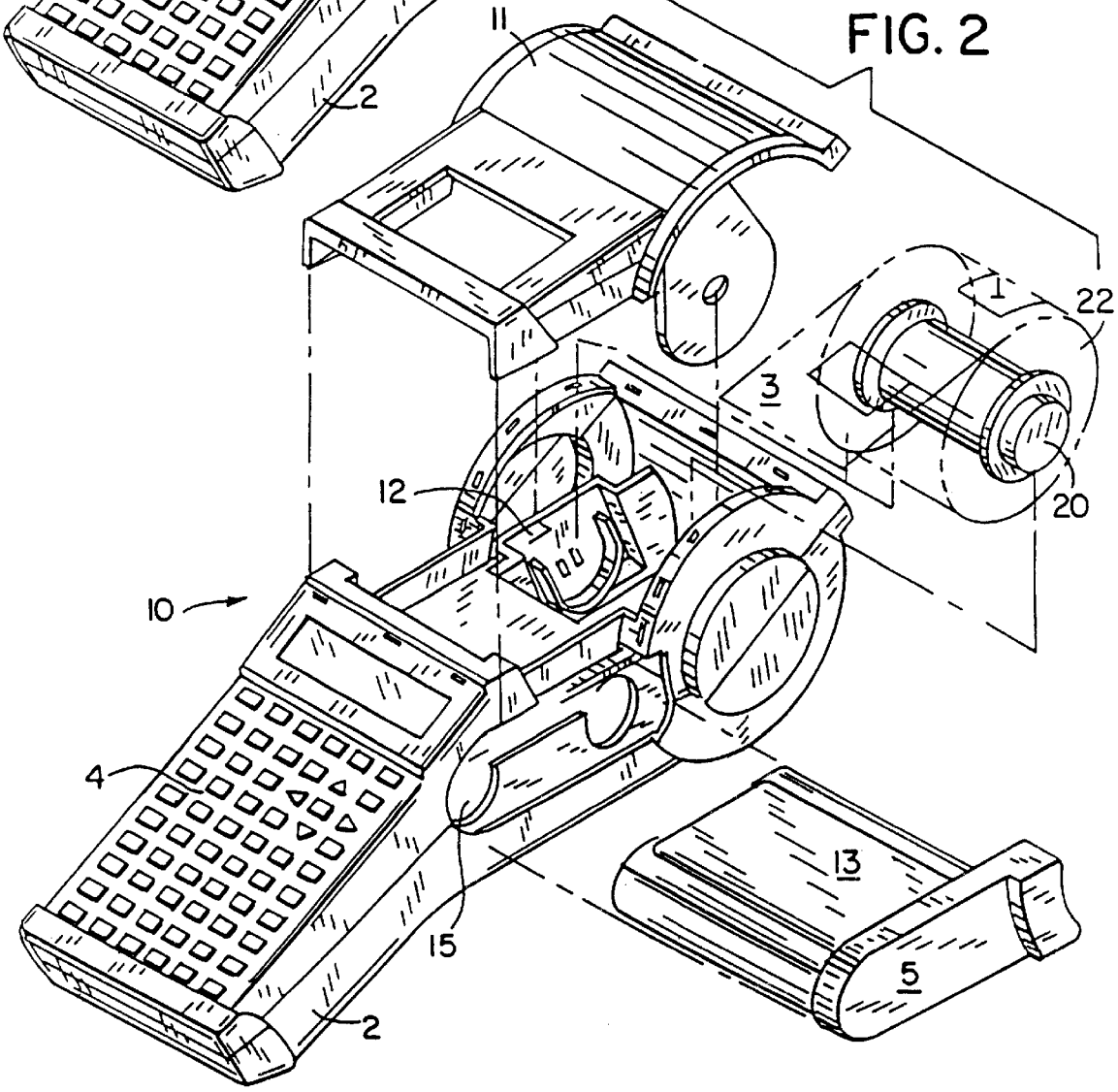
FIG. 2 is an exploded perspective view of the printer in FIG. 1.
Figure 3:
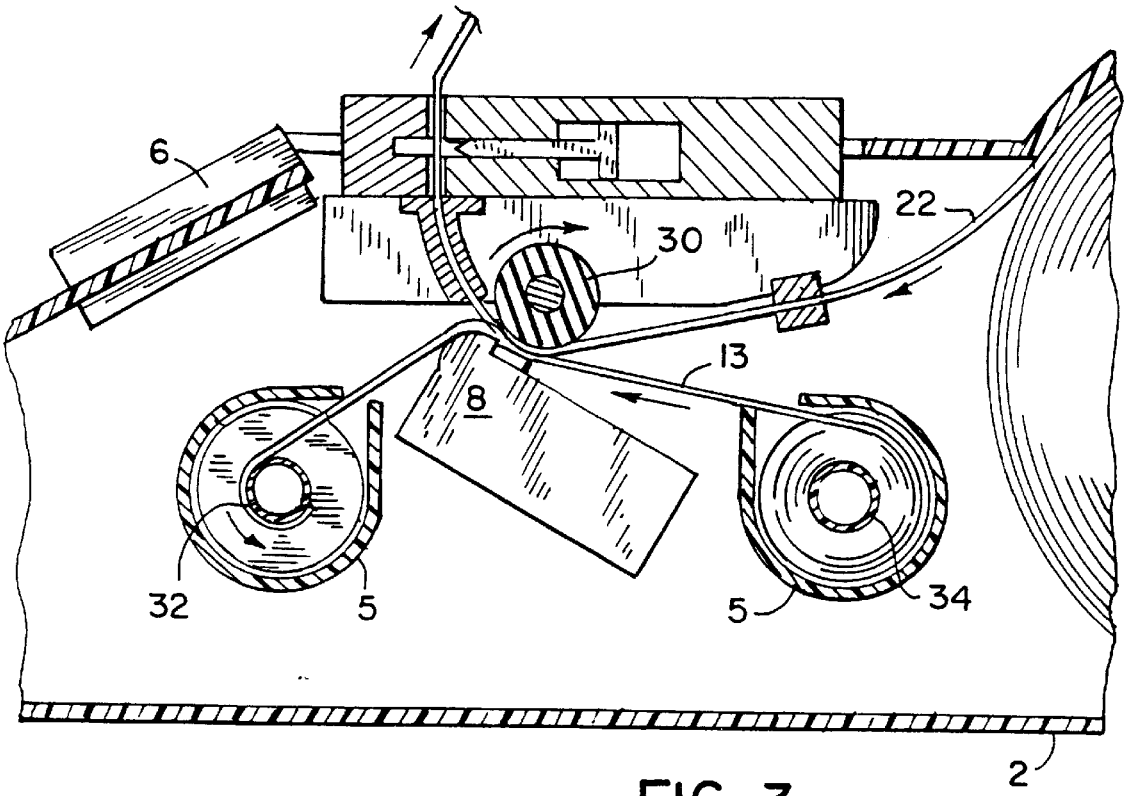
FIG. 3 is a section view of the printer in FIG. 1 showing the ink ribbon and labeling media path.

Referring particularly to FIGS. 1 and 2, a thermal transfer printing machine 10 which employs the preferred embodiment of the present invention includes a molded plastic housing 2 that supports a keyboard 4 on its front surface and a display 6 positioned above the keyboard 4. A cavity 12 formed in the housing 2 above the display 6 receives a spool 20 containing labeling media 22. The labeling media 22 is formed as a roll which is carried by the spool 20. The spool 20 is inserted into a receptacle cavity 12 on the printer 10 and the labeling media 22 is threaded past a print head 8, as shown in FIG. 3. A cover 11 enclosing the spool 20 and labeling media 22 in the receptacle cavity 12 is pivotally attached to the housing 2.

The labeling media 22 is comprised of a carrier web 3 which supports a series of adhesive labels 1. The size, color, and type of label material carried by the spool 20 varies depending upon the particular print application. The labeling media 22 unrolls off the spool 20 as it is consumed by the printer 10.

Figure 6:
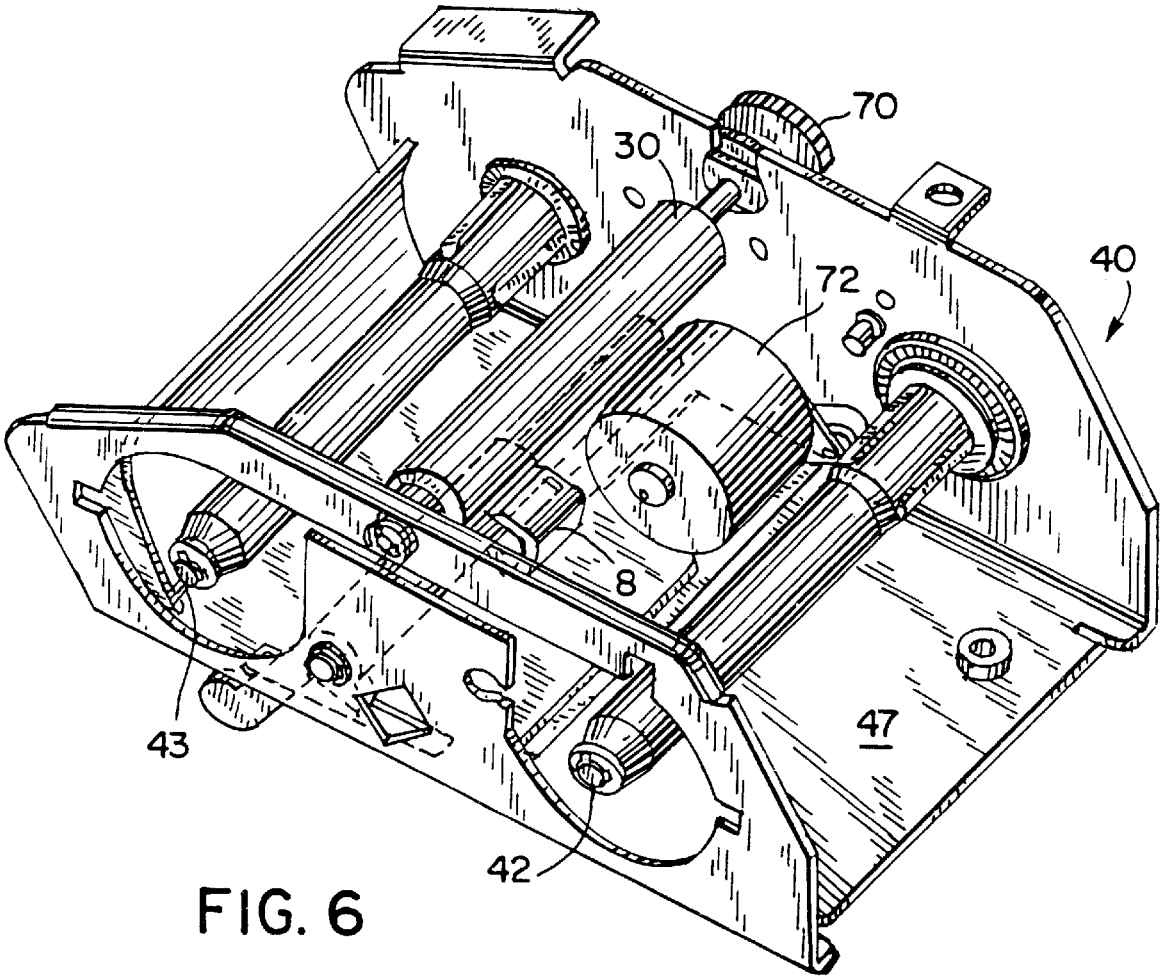
FIG. 6 is a perspective view of the print frame assembly in FIG. 4.

An ink ribbon cartridge 5, shown in FIGS. 2, 3 and 6, having a thermal transfer ribbon 13 disposed within the cartridge 5 is inserted into a cavity 15 in the side of the printing machine housing 2 and received by a print frame assembly 40. The ribbon cartridge 5, shown in FIG. 2, rotatably accommodates a supply spool 34 containing the ribbon 13 for thermal transfer printing onto a labeling media 22 and the take up spool 32 for taking up the inked ribbon 13 as it is used in the thermal transfer printing process. When the direction of ink ribbon 13 travel is reversed, the ink ribbon 13 is taken up by the supply spool 34 and ribbon 13 is unwound from the take up spool 32. The ink ribbon cartridge as used with this invention is fully described in copending patent application THERMAL TRANSFER RIBBON CARTRIDGE, U.S. patent application Ser. No. 09/033,341 filed simultaneously with the present patent application and incorporated by reference herein.

As shown in FIG. 3, a thermal print head 8 in the printing machine 10 is arranged to cooperate with the thermal transfer ribbon 13 and the labeling media 22 such that the print head 8 can print characters or symbols on the labeling media. This is described in greater detail in U.S. Pat. No. 5,078,523 which is incorporated herein by reference.

More specifically, a cam mechanism (not shown) within the printing machine 10 urges the print head 8 into close abutting relation with the labeling media 22 and ribbon 13 captured between a drive roller 30 and the print head 8. Circuitry in the printing machine 10 drives the drive roller 30 and a take up spool 32 to advance the labeling media 22 and ribbon 13. When a desired character is input by an operator or other means, the electronics of the machine 10 energizes pixels on the thermal transfer head 8 as the labeling media 22 and ribbon 13 advance past the head 8. The head pixels are variously energized to imprint the character on the labeling media 22. This is described in greater detail in U.S. Pat. No. 5,078,523 which has been incorporated herein by reference.

Figure 4:
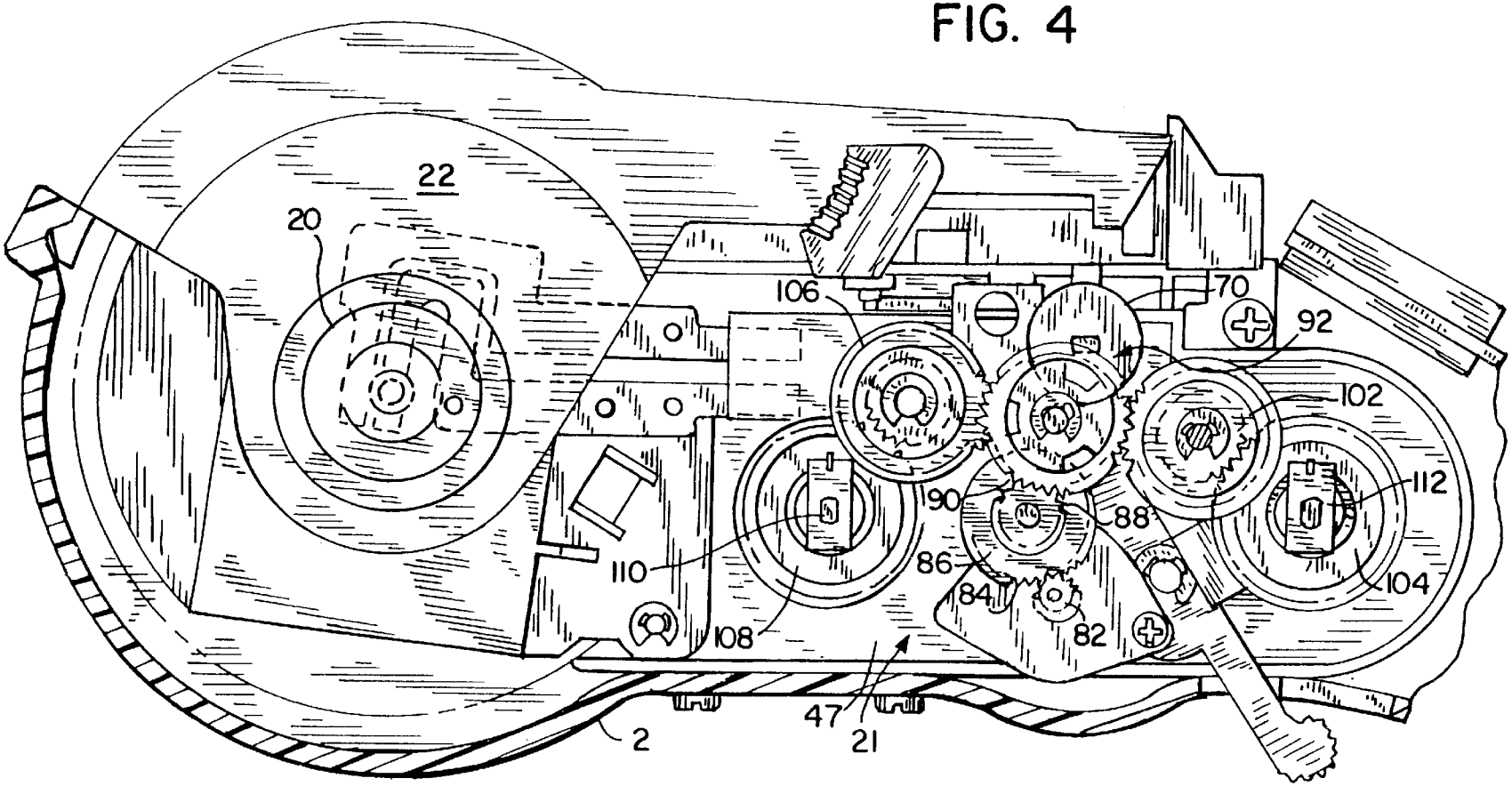
FIG. 4 is a side view of a drive mechanism on the print frame of the printer in FIG. 1.

Referring to FIGS. 4 and 6, drive spindles, 42 and 43, of a bidirectional stepping motor gear mechanism 21 mounted on a U-shaped print frame 47 rotatably drive the appropriate spool of the cartridge 5 to take up and supply the ink ribbon 13 past the print head 8. The stepping motor gear mechanism 21 is engageably driven by a stepping motor 72 mounted in the print frame assembly 40. The print frame assembly 40 is mounted within the printing machine housing 2.

The labeling media 22 and ribbon 13 are advanced past the print head 8 by a drive roller 30 that maintains the ribbon 13 and labeling media 22 in close cooperation with the print head 8. As fully described below, the drive roller 30 is rotatably driven by a bidirectional stepping motor 72 shown in FIG. 6.

In order to minimize wrinkling when the ink ribbon 13 reverses direction, a delay is introduced in the bidirectional stepping motor gear mechanism 21 to pretension the ribbon 13 prior to feeding labeling media 22 and ribbon 13 past the print head 8. The essence of the invention is the delay between reversing the ink ribbon tension and the rotation of the drive roller 30. When the stepping motor 72 reverses direction, the drive roller 30, which advances the labeling media 22 and ribbon 13, stalls momentarily while the spindle 42 or 43 that will drive the spool, winding ribbon thereon, begins pulling the ribbon 13 in the desired direction. This has the effect of pulling all the slack out of the ribbon 13 before the labeling media 22 and ribbon 13 begin to feed past the print head 8. The introduction of the delay prevents wrinkles from developing in the ink ribbon 13 and being pulled over the print head 8.

By energizing the drive motor 72 prior to engaging the drive roller 30, extra motor movement is required to properly position the labeling media 22 and ribbon 13. In order to properly position the labeling media 22 after the ribbon 13 tension has been reversed, the extra motor movement must be taken into account. In the preferred embodiment shown in FIG. 4, additional stepping motor steps are added to compensate for the known backlash in the gear mechanism 21, thus returning the labeling media 22 and ribbon 13 to the position prior to advancement to the cutting or dispensing position.

Looking at FIG. 4, the delay between reversing the ribbon 13 tension and reversing the labeling media 22 and ribbon 13 movement is accomplished by incorporating a backlash idler gear assembly 92 in the stepping motor gear mechanism 21. In particular, as shown in FIGS. 4 and 6, a stepping motor 72 mounted to the inside of a U-shaped print frame 47 has a rotatable shaft 80 extending through a wall of the print frame 47. A pinion 82 mounted on the rotatable shaft 80 engages outer gear teeth 84 of a motor idler gear 86 rotatably mounted to the print frame 47. Inner gear teeth 88 of the motor idler gear 86 engage an outer backlash gear 90 of the backlash idler gear assembly 92.

Figure 5:
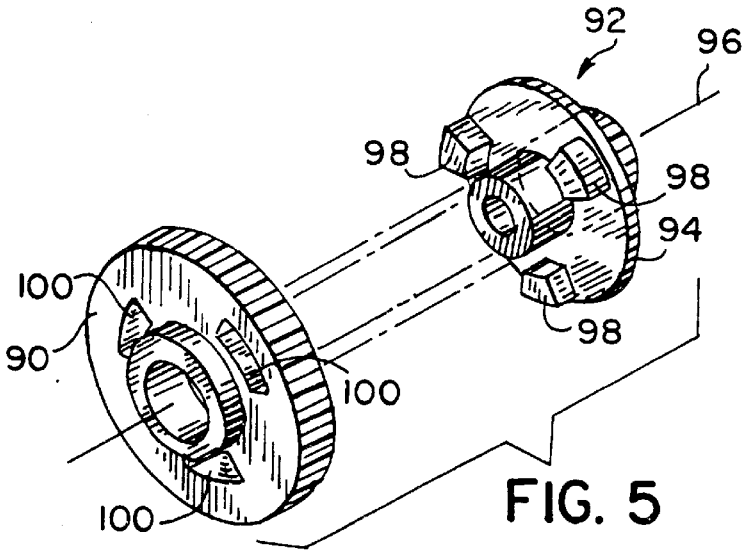
FIG. 5 is an exploded perspective view of the backlash idler gear assembly in FIG. 4.

Referring particularly to FIG. 5, the backlash idler gear assembly 92 comprises the outer backlash gear 90 and an inner backlash gear 94. The inner backlash gear 94 is mounted for rotation about the same axis 96 as the outer backlash gear 90. Extensions 98 formed on one face of the inner backlash gear 94 extends axially through corresponding slots 100 formed in the face of the outer backlash gear 90. When the outer backlash gear 90 is rotated, the extensions 98 couple the rotational motion to the inner backlash gear 94. However, because these extensions 98 are smaller than the slots 100, when this gear 90 changes direction, the gear 94 is not driven for a short interval. This interval is determined by the relative sizes of the extensions 98 and slots 100.

Referring back to FIGS. 4–6, in order to advance the labeling media 22 and ribbon 13, the inner backlash gear 94 engages a drive roller gear 70 that is rotatably mounted on the print frame 47 and rigidly attached to the drive roller 30. The drive roller 30 also urges the ink ribbon 13 and labeling media 22 in close proximity to the print head 8 along the ribbon and media paths while advancing the labeling media 22 and ribbon 13 past the print head 8 during the printing process.

The stepping motor gear mechanism 21 rotatably drives the take up and supply spools, 32 and 34, by rotatably engaging drive spindles. The outer backlash gear 90 engages a pair of idler gears, 102 and 106, rotatably mounted to the print frame 47. The first idler gear 102 of the pair of idler gears engages a take up spool spindle gear 104. The second idler gear 106 of the pair of idler gears engages the supply spool spindle gear 108. The spindle gears, 104 and 108 drivingly engage the spindles, 42 and 43, through spring clutches, 110 and 112 combined with one-way roller clutches (not shown) which are internal to the spindles, 42 and 43.

Spindle gears, 104 and 108, are sized to "overdrive" the spools, 32 and 34. In the forward direction, spool 32 is overdriven when it can take up the ribbon 13 faster than the drive roller 30 can feed the ribbon 13, thereby creating a tension in the ribbon 13 between the drive roller 30 and the take up spool 32. When the spindle 42 is driving the spool 32 taking up the ribbon 13, the resistance of the slip clutch 112 determines how much tension is in the ribbon 13 past the drive roller 30. In the reverse direction, spool 34 takes up the ribbon 13 and slip clutch 110 determines how much tension is in the ribbon 13 past the drive roller 30.

When the spindle is acting as the supply, the ribbon spool is rotating freely compared to the spool taking up the ribbon. In the forward direction, the tension on the ribbon 13 between the drive roller 30 and the supply spool 34 is then determined by the drag on the spool 34 provided the components inside the cartridge 5. In the reverse direction, spool 32 acts as the supply spool and the drag on the spool 32 provided by the cartridge 5 components determines the ribbon tension as the ribbon feeds toward the print head 8. The ink cartridge 5 is fully described in copending application THERMAL TRANSFER RIBBON CARTRIDGE, U.S. patent application Ser. No. 09/033,341 filed simultaneously with the present patent application which has been incorporated by reference herein.

The delay introduced into the gear mechanism 21 by the backlash gear assembly 92 ensures that tension is maintained in the ribbon 13 on both sides of the print head 8 when the labeling media 22 and ribbon 13 reverses direction. The presence of the ribbon tension reduces wasting labeling media 22 by minimizing the possibility of a ribbon wrinkle passing over the print head 8.

The present embodiment does not advance or reverse the labeling media and ribbon independent of each other, therefore conserving ink ribbon is not an objective of the embodiment. However, it should be understood that the present invention of introducing a delay between reversing the ribbon tension and the advancing the ribbon in the reverse direction will minimize ribbon wrinkling whether or not the ribbon and labeling media are capable of advancing and reversing independent of each other.

Various methods known in the art may be used to practice the present invention as claimed herein. The preferred embodiment introduces the delay in a stepping motor gear mechanism by introducing a predetermined backlash in the gear mechanism of the ribbon transmission system, however, a pulley and belt system is another arrangement that could be used.

While there has been shown and described what are at present considered the preferred embodiment of the invention, it will be obvious to those skilled in the art that various changes and modifications can be made therein without departing from the scope of the invention defined by the appended claims.

We claim:

1. A bidirectional ribbon transmission system comprising:

a bidirectional motor having a rotating shaft;

an outer backlash gear rotatably driven by rotation of the motor shaft;

an inner backlash gear engaged with the outer backlash gear for rotation by said outer backlash gear, wherein the engagement between the outer and inner backlash gears provides an interval during which the inner backlash gear is not rotated each time the outer backlash gear changes direction of rotation;

means driven by said outer backlash gear for rotating drive spindles to take up an ink ribbon advanced past a print head; and a drive roller means driven by said inner backlash gear for moving said ribbon and labeling media past said print head.

2. A bidirectional ribbon transmission system as in claim 1 wherein the engagement between said outer backlash gear and the inner backlash gear is provided by slots formed in a face of one of said gears and extensions formed on a face of the other gear and wherein said extensions extend into said slots and the interval is produced by forming the slots larger than the extensions.

3. A bidirectional ribbon transmission system as in claim 1 in which the means driven by the outer backlash gear includes a pair of spindle idler gears having individual slip clutches, wherein said ribbon is overdriven causing one of said clutches to slip when said clutch is driving one of said spindles taking up said ribbon.

* * * * *

UNITED STATES PATENT AND TRADEMARK OFFICE

CERTIFICATE OF CORRECTION

PATENT NO. : 5,951,177
DATED : September 14, 1999
INVENTOR(S) : Schanke et al.

It is certified that error appears in the above-identified patent and that said Letters Patent is hereby corrected as shown below:

U.S. PATENT DOCUMENTS

| Patent Number | Issue date | Patentee | Class | Subclass |
|---|---|---|---|---|
| 4724033 | 2/9/1988 | Vanderpool et al. | 156 | 365 |
| 5052832 | 10/1/91 | Akiyama et al. | 400 | 120 |
| 5820277 | 10/13/98 | Schulte | 400 | 223 |

FOREIGN PATENT APPLICATION

| Document Number | Publication Date | Patent Office |
|---|---|---|
| 0 641 663 | 3/8/95 | European Patent Office |

Signed and Sealed this

Sixth Day of November, 2001

*Attest:*

Nicholas P. Godici

NICHOLAS P. GODICI

*Attesting Officer*

*Acting Director of the United States Patent and Trademark Office*